United States Patent [19]

Bammel et al.

[11] Patent Number: 4,898,652

[45] Date of Patent: Feb. 6, 1990

[54] POLYOXALKYLATED POLYHYDROXY COMPOUNDS AS ADDITIVES IN ZINC ALLOY ELECTROLYTES

[75] Inventors: Brian D. Bammel, Canton; Walter J. Wieczerniak, Utica; Kenneth D. Snell, Rochester, all of Mich.

[73] Assignee: OMI International Corporation, Warren, Mich.

[21] Appl. No.: 265,962

[22] Filed: Nov. 2, 1988

Related U.S. Application Data

[63] Continuation-in-part of Ser. No. 835,489, Mar. 3, 1986, abandoned.

[51] Int. Cl.[4] ..... C25D 3/56

[52] U.S. Cl. ..... 204/44.2

[58] Field of Search ..... 204/44.2, 44.5, 123

[56] References Cited

U.S. PATENT DOCUMENTS 4,285,802 8/1981 Rynne ..... 204/44.2
4,388,160 6/1983 Rynne ..... 204/44.2 X
4,515,663 5/1985 Strom et al. ..... 204/44.2
4,578,158 3/1986 Kanamara et al. ..... 204/44.2
4,597,838 7/1986 Bammel ..... 204/44.2

*Primary Examiner*—G. L. Kaplan
*Attorney, Agent, or Firm*—Richard P. Mueller

[57] ABSTRACT

An improved aqueous acidic electrolyte suitable for electrodepositing zinc alloys comprising a combination of zinc and at least one metal selected from the group consisting of nickel, cobalt, iron, and mixtures thereof incorporating an effective amount of an additive agent for providing improved grain-refinement and enhancing the adjustment of the codeposition of the alloying metals in the zinc alloy deposit. The additive agent comprises a bath soluble polyhydroxy compound having three or more hydroxyl groups at least one of which is substituted with a polyoxyalkylene group.

The present invention further encompasses the process of employing the aforementioned electrolyte for the deposition of functional and decorative zinc alloy electrodeposits.

55 Claims, No Drawings

POLYOXALKYLATED POLYHYDROXY COMPOUNDS AS ADDITIVES IN ZINC ALLOY ELECTROLYTES

BACKGROUND OF THE INVENTION

This application is a continuation-in-part application of U.S. Pat. Appl. Ser. No. 835,489, filed Mar. 3, 1986 and now abandoned entitled "Polyoxyalkylated Polyhydroxy Compounds as Additives in Zinc Alloy Electrolytes".

The present invention broadly relates to an improved electrolyte and process for electrodepositing zinc alloys, and more particularly, to an improved aqueous acid zinc alloy electrolyte containing novel additive agents for providing improved grain-refinement, reduced dendrite formation, increased adhesion and ductility and an unexpected adjustment in the codeposition of one or more alloying metals in the zinc alloy deposit.

Electrolytes incorporating zinc ions in further combination with one or a combination of nickel, cobalt, iron or mixtures thereof have heretofore been used or proposed for use for depositing zinc alloy deposits of a decorative or functional type on a variety of conductive substrates such as iron and steel, for example, to provide for improved corrosion resistance, enhance appearance and/or to build up the surface of a worn part enabling refinishing thereof to restore its original operating dimensions. Such zinc alloy electrolytes and processes are in widespread commercial use for industrial or functional plating including strip plating, conduit plating, wire plating, rod plating, tube plating, coupling plating, and the like. A continuing problem associated with such prior art zinc alloy electrolytes has been the inability to achieve the desired grain-refinement of the alloy electrodeposit to provide the requisite semi-bright appearance and associated physical properties including adhesion and ductility. A further problem has been the inability to increase the percentage of the alloying metal constituent such as nickel, cobalt and/or iron in the zinc alloy electrodeposit in order to achieve desired physical and chemical properties. The formation of dendrites on the substrate being plated at high current density areas has also been objectionable.

The present invention provides for an improved electrolyte for electrodepositing zinc alloys incorporating an additive agent or mixture of additive agents which provides for improved grain-refinement, a reduction in dendrite formation, increase in adhesion and ductility while further adjusting the codeposition of the alloying metal ions achieving a zinc alloy electrodeposit of improved properties.

SUMMARY OF THE INVENTION

The benefits and advantages of the present invention in accordance with the composition aspects thereof are achieved by an aqueous acidic zinc alloy electrolyte containing zinc ions in conventional amounts in further combination with controlled amounts of at least one additional alloying metal ion selected from a group consisting of nickel, cobalt, iron and mixtures thereof. The electrolyte further contains as an essential constituent, an additive agent present in an amount effective to achieve improved physical characteristics of the zinc alloy deposit comprising a bath soluble polyhydroxy compound having three or more hydroxyl groups of which at least one is substituted with a polyoxyalkylene group as well as mixtures thereof. The concentration of the polyoxyalkylene-substituted polyhydroxy additive agent is present in an amount effective to impart improved grain-refinement to the electrodeposit and the specific concentration will vary depending upon whether the electrolyte is of the chloride, sulfate, fluoborate, sulfamate or mixed-chloride type.

In addition to the foregoing constituents, the zinc alloy electrolyte may additionally contain various other additive agents of the types conventionally employed including buffering agents, supplemental brightening agents, bath soluble and compatible conductivity salts to increase the electrical conductivity of the electrolyte and the like.

In accordance with the process aspects of the present invention, a zinc alloy coating is electrodeposited on a conductive substrate employing the aforementioned aqueous acidic zinc alloy electrolyte which is controlled at a temperature typically ranging from about room temperature (60° F.) up to about 180° F. and is operated at an average cathode current density ranging from as low as about 1 up to as high as about 2000 amperes per square foot (ASF) or higher which will vary depending upon the specific type and composition of the electrolyte as well as the geometry and processing parameters employed in the plating operation.

Further benefits and advantages of the present invention will become apparent upon a reading of the Description of the Preferred Embodiments taken in conjunction with the specific examples provided

DESCRIPTION OF THE PREFERRED EMBODIMENTS

The aqueous acidic zinc alloy electrolyte in accordance with the composition aspects of the present invention contains zinc ions present in an amount effective to electrodeposit zinc from the electrolyte and generally can range from as low as about 10 g/l up to saturation, with concentrations of from about 15 to about 225 g/l being more usual. Preferably, for most applications, the zinc ion concentration is controlled within a range of about 20 to about 200 g/l. The maximum concentration of zinc ions will vary depending upon the temperature of the electrolyte with higher temperatures enabling use of higher concentrations. The zinc ion concentration will also vary depending upon the type of electrolyte employed which may be of the chloride, sulfate, mixed chloride-sulfate, sulfamate, as well as the fluoroborate types. In acid chloride-type electrolytes, the zinc ion concentration is generally controlled at a level within the lower end of the permissible range whereas in acid sulfate-type electrolytes, the zinc ion concentration is generally controlled at a level within the upper range of the permissible concentrations.

The zinc ions are introduced into the electrolyte in the form of zinc anodes or soluble zinc salts such as a chloride, sulfate, sulfamate and/or fluoroborate salt in further combination with an acid such as sulfuric acid, hydrochloric acid, fluoroboric acid, sulfamic acid, or the like corresponding to the type of zinc salt employed. Generally the pH of the zinc alloy electrolyte is controlled within a range of about 0 up to about 7 with a pH of from about 2 to about 6 being preferred.

In addition to the zinc ions, the electrolyte further contains controlled amounts of at least one of the alloying metal ions including nickel, cobalt, and/or iron which similarly are introduced in the form of soluble anodes or bath soluble salts of the alloying metal including the chloride, sulfate, fluoroborate, acetate, or sulfamate as well as mixtures thereof. When nickel and/or cobalt are employed as the alloying metal, each can be employed in the bath in amounts of from about 0.5 g/l up to about 120 g/l to provide alloy deposits containing from about 0.1 up to about 30 percent by weight of nickel and/or cobalt. Preferably, the alloy deposit contains from about 0.25 percent to a total of about 15 percent of both nickel and/or cobalt, and the bath under such conditions contains nickel and/or cobalt ions in an amount usually ranging from about 3 g/l to about 65 g/l, respectively.

When iron comprises an alloying metal in the electrolyte, the operating iron ion concentration can range of from about 5 g/l up to about 140 g/l with concentrations of from about 40 g/l up to about 100 g/l being preferred.

When iron ions are present in the electrolyte which is only weakly acidic or either neutral, such as at a pH of from about 4 to about 6.5, it is generally preferred to incorporate conventional complexing or chelating agents to maintain an effective amount of the iron metal ions in solution. Chelating or complexing agents which are particularly satisfactory for this purpose include citric acid, gluconic acid, glucoheptanoic acid, tartaric acid, ascorbic acid, isoasorbic acid, malic acid, glutaric acid, muconic acid, glutamic acid, glycollic acid, aspartic acid, and the like as well as their alkaline metal, ammonium, zinc or ferrous salts.

While the iron ions are introduced into the electrolyte in the ferrous state, ferric ions are formed during the plating operation and it has been found that excessive amounts of ferric ions are objectionable resulting in the formation of striations on the zinc alloy plated surface. Accordingly, it has been found desirable to control the ferric ion concentration at a level usually less than about 2 g/l. This can be accomplished by employing a soluble zinc or iron anode in the electroplating bath or, alternatively, by immersing metallic zinc or iron in the holding tank through which the electroplating solution is circulated. When no soluble anodes are employed or no zinc or iron metal is provided in the holding tank, proper control of the ferric ion concentration can be achieved by employing suitable bath soluble and compatible organic and/or inorganic reducing agents such as, for example, bisulfite, isoascorbic acid, monosaccharides and disaccharides such as glucose or lactose.

It will be appreciated from the foregoing, that electrolytes can be formulated to provide for appropriate binary, ternary or quaternary alloys containing predominately zinc and at least one of the other three alloying metal constituents.

When ternary alloy deposits are desired containing zinc-nickel-iron or zinc-cobalt-iron, the concentration of the metal ions in the electrolyte are usually controlled so as to provide an alloy containing from about percent to about 25 percent iron in combination with either about 0.1 to about 20 percent by weight nickel or about 0.1 to about 12 percent cobalt and the balance essentially zinc.

In addition to the metal ions present in the electrolyte, the electrolyte further contains an additive agent comprising a bath-soluble, aliphatic polyhydroxy compound. Such additive agents preferably have a minimum of three carbons and at least three or more available hydroxy groups. Preferably, at least one hydroxy group of this agent is substituted with a epoxide group or residue, i.e., a water soluble polyoxyalkylene group other than a fatty acid group. These may preferably be selected from the group consisting of oxyethylene, oxypropylene, glycidol, oxybutylene, or mixtures thereof. Also preferably, the number of moles of oxyalkylene groups per mole of additive present in the additive agent ranges from about 2 to at about 120. More preferably, the number of moles of oxyalkylene groups present ranges from 12 to 40 moles per mole of additive. The hydroxy groups of the polyhydroxy compound are preferably attached to at least one carbon atom, and preferably are not components of a carboxylic acid moiety.

As noted above, the alkoxylated polyhydroxy compounds employed as additives for the electrolyte of the instant invention should not contain any substantial amount of fatty acid residues. Accordingly, in a highly preferred embodiment, they are substantially free of fatty acids or fatty acid moieties. This is because fatty acids, and moieties of such materials, tend to react with the hydroxy groups of the polyhydroxy molecule and form undesirable esters. Such esters, which are commonly used commercially as insoluble fats, dispersible soaps, and detergents, are generally ineffective as or otherwise interfere with commercial aqueous zinc alloy electrolytes. Further, such fatty acid derivatives generally have an insufficient number of hydroxy groups per molecule available for alkoxylation; those fatty acid derivatives which do contain a sufficient amount of hydroxy groups, however, are not commercially viable due to excessive foam levels which generally render them industrially- and environmentally-unacceptable for most electrodeposition applications.

Polyhydroxy compounds which may be suitable for alkoxylation in the present invention to form additive agents include suitable water soluble compounds such as mono- or polysaccharides. Such materials include, without limitation, alditols, aldoses, aldonic acids, aldaric acids, uronic acids, aldolactones, amyloses, soluble celluloses, and the like. Preferred materials inolude, for example and without limitation, polyhydroxy compounds from the group consisting of sorbitol, glucose, methyl glucose, gluconic acid, glucaric acid, mannitol, fructose, glycerin, trimethylol propane, pentaerythritol, trihydroxy butane, trihydroxy butanone, trihydroxy hexane, chlorobutane triol, 2-ethyl, -2-(hydroxymethyl) 1,3 propane diol, tris(hydroxymethyl)ethane, tris(hydroxymethyl)amino methane, 3-[tris(hydroxymethyl)-methyl amino]1-propane sulfonic acid, tricine, or mixtures thereof. More preferably, such polyhydroxy compounds are selected from the group consisting of sorbitol, methylglucose, glycerin, trimethylol propane, pentaerythritol, trihydroxy butane, tris(hydroxymethyl)ethane, or mixtures thereof. Highly preferred materials include sorbitol, methylglucose, glycerine, and trimethylolpropane, or mixtures thereof.

It will be appreciated that the polyhydroxy compounds employed in the present invention may contain additional groups or moieties present as extraneous portions of the polyhydroxy molecule, provided that such additional groups do not unduly interfere with the activity of the additive. For instance, the polyhydroxy additive agent may contain additional groups such as halides, aldehydes, ketones, carboxylic groups, sulfonic groups, amino groups, or mixtures thereof. As noted above, however, such additional groups or moieties should not unduly interfere with activity of the additive agents. It will be appreciated by the skilled artisan that this can be most easily accomplished by making certain that the presence of the group does not substantially interfere with successful alkoxylation of the polyhydroxy compound, or render the resulting product insoluble, for example, due to cross-linking.

A mixture of such additive agent materials may also be employed as an additive agent, as may polymeric materials prepared from one or more of these materials as monomers.

The molecular weight of the additive agent or mixtures is preferably controlled such that the final additive agent is souble in the electrolyte at the desired concentration. Thus, the useful molecular weight range of polymeric alkoxylated polyhydroxy additive agent compound will be from about 100 to about 10,000 or more. More preferably, however, the molecular weight range of the polymeric alkoxylated polyhydroxy compound will be from about 500 to about 8,000. In these preferred molecular weight ranges, the polyhydroxy compound selected should be small enough to prevent substantial interference with the cathodic activity of attached ether chains. It will be appreciated that the additive agent may also contain one or more polyoxyalkylene substitute group on the molecule or may contain two, three or more substitute groups, depending upon the degree of substitution and the number of reactive hydroxyl groups on the molecule; solubility is the primary functional limitation.

The concentration of the additive agent in the electrolyte will vary depending upon the concentration and types of other bath constituents present, the desired alloy deposit composition, and whether the electrodeposit is to be employed for functional or decorative purposes. Generally speaking, the additive agent is employed in an amount effective to produce a refinement of the grain of the electrodeposit, to reduce the tendency to form dendrites during the electrodeposition process, to enhance the adhesion and ductility of the deposit to the substrate, and to adjust the codeposition of the alloying metal ions in the zinc alloy deposit and to regulate the alloy content at a more uniform, desired level. For this purpose, concentrations as low as about 0.005 up to about 20 g/l have been found usable while concentrations of from about 0.02 up to about 10 g/l are more typical and preferred for most uses.

In accordance with a preferred practice of the present invention, the additive agent is employed in sulfate-based zinc-iron electrolytes in a concentration range of about 0.005 to about 0.1 g/l providing both an increase in the codeposition of iron in the zinc-iron deposit and a grain refinement thereof. In sulfate-based zinc-nickel alloy electrolytes, a concentration range of about 0.005 to about 0.1 g/l is also preferred providing improved ductility and adhesion of the deposit accompanied by a slight improvement in grain refinement. In sulfate-based zinc-cobalt alloy electrolytes, the preferred concentration range of the additive agent ranges from about 0.05 to about 5 g/l providing a grain refined, ductile and adherent electrodeposit. An all chloride system for alloy plating, on the other hand, would require a preferred concentration of 0.1–10 g/l for all alloy versions to be produced.

The additive agent can be employed by itself in combination with the metal ions in the electrolyte to produce a semi-bright electrodeposit typical of a functional plating. When a decorative electrodeposit is desired having enhanced brightness, supplemental brightening agents of the types known in the art can be incorporated in the electrolyte in the usual amounts. Typical of supplemental brighteners that can be employed to further enhance the crystal structure and brightness of the zinc alloy electrodeposid are those disclosed in U.S. Pat. Nos. 4,170,526; 4,207,150; 4,176,017; 4,070,256 and 4,252,619. When employed, such supplemental brightening agents can be used at concentrations up to about 10 g/l with concentrations as low as about 0.001 g/l being effective. Typically, the concentration of the supplemental brightening agents range from about 0.01 up to about 5 g/l.

In addition to the foregoing essential and optional constituents, the electrolyte can further include supplemental additives such as buffers and bath modifiers such as boric acid, acetic acid, citric acid, benzoic acid, salicylic acid, as well as their bath soluble and compatible salts, ammonium chloride and the like. Other bath soluble and compatible salts such as ammonium sulfate, ammonium chloride or bromide, sodium chloride, potassium chloride, ammonium fluoroborate, magnesium sulfate, sodium sulfate, and combinations thereof and the like can also be employed in amounts usually ranging from about 20 up to about 450 g/l to increase the electrical conductivity of the electrolyte. Typically, such conductivity salts comprise alkali metal salts such as chlorides, sulfates, sulfamates and fluoroborates. Also, bath modifiers such as bath soluble and compatible polyhydroxy compounds containing at least three hydroxyl groups and at least four carbon atoms of the class described in U.S. Pat. No. 4,515,663, the teachings of which are incorporated herein by reference, can be used in amounts of about 3 up to about 30 g/l to inhibit insoluble polyborate compound formation during operation of the bath.

In accordance with the process aspects of the present invention, the zinc alloy electrolyte is employed to electrodeposit a desired zinc alloy on a conductive substrate employing electrolyte temperatures ranging from about room temperature (60° F.) up to about 180° F. and more typically, from about 70° to about 140° F. The electrodeposition of the zinc alloy can be carried out at current densities ranging from as low as about 1 up to about 2000 ASF or higher. For decorative chloride-type electrolytes, current densities of from about 1 to about 80 ASF are generally preferred, whereas for functional sulfate-type or chloride-type electrolytes, current densities of from about 20 to about 2000 ASF can be employed. During the electrodeposition process, the bath or electrolyte is preferably agitated mechanically or by solution circulation or part movement. While air agitation can be employed, the use of air agitation with electrolytes containing iron ions is less desirable due to the tendency to increase the formation of ferric ions in the bath.

In order to further illustrate the electrolyte composition and process of the present invention, the following examples are provided. It will be understood that the examples are provided for illustrative purposes and are not intended to be limiting of the scope of the present invention as herein described and as set forth in the subjoined claims.

EXAMPLE 1

For comparative purposes, an aqueous acidic sulfate-type zinc-iron alloy electrolyte was prepared for functional electrodeposits containing 110 g/l zinc sulfate monohydrate and 370 g/l ferrous sulfate heptahydrate. The pH of the electrolyte was about 2.

The electrolyte was employed for electrodepositing a zinc-iron deposit on a steel rod cathode rotating at a speed of 3,055 rpm to provide a surface velocity of about 200 feet per minute. The electrolyte was controlled at a temperature of 50° C. (122° F.) and soluble zinc anodes were employed. The electrodeposition was carried out at an average cathode current density of about 500 ASF. The resultant zinc-iron alloy deposit was observed to be of a gray and grainy appearance which upon analysis contained 13.8% by weight iron.

EXAMPLE 2

To the electrolyte as described in Example 1, 0.01 g/l of an additive agent comprising ethoxylated sorbitol of an average molecular weight of 1400 was added. A rotating steel cathode was again plated under the same conditions as described in Example 1. The resultant zinc-iron alloy deposit was of a silvery-blue and semi-bright appearance which upon analysis was found to contain 13.2% by weight iron.

EXAMPLE 3

To the electrolyte as described in Example 1, 0.05 g/l of an additive agent was added comprising propoxylated sorbitol of an average molecular weight of 500. A rotating steel cathode was again electroplated under the same conditions as described in Example 1 The resultant zinc-iron alloy deposit was of a blue-gray and semi-bright appearance which upon analysis was found to contain 18.6% by weight iron.

EXAMPLE 4

To the electrolyte as described in Example 1, 0.01 g/l of an additive agent was added comprising ethoxylated methyl glucose (ethoxylated with 10 moles of ethylene oxide). A rotating steel cathode was electroplated under the same conditions as described in Example 1. The resultant zinc-iron alloy deposit was of a satiny-gray and semi-bright appearance which upon analysis was found to contain 15.5% by weight iron.

EXAMPLE 5

To the electrolyte as described in Example 1, 0.01 g/l of an additive agent was added comprising a propoxylated methyl glucose (propoxylated with 10 moles of propylene oxide). A rotating steel cathode was electroplated under the same conditions as described in Example 1. The resultant zinc-iron alloy deposit was of a satiny-gray appearance and upon analysis contained 17.1% by weight iron.

EXAMPLE 6

For comparative purposes, an aqueous acid zinc-nickel alloy electrolyte of the sulfate-type was prepared for functional plating. The electrolyte contained 310 g/l nickel sulfate hexahydrate, 205 g/l zinc-sulfate monohydrate and 36 g/l sulfuric acid. The electrolyte was adjusted to a temperature ranging from 60° to 65° C. (140° to 150° F.) and a rotating steel cathode was plated at an average cathode current density of 1,000 ASF employing insoluble lead anodes. Solution agitation was provided by rotating the cathode. The cathode was rotated at a speed of 4,600 rpm providing a surface velocity of 325 feet per minute. The resultant deposit was of a light gray color, grainy appearance and evidenced poor adhesion in response to being bent through an angularity of greater than 90. as viewed under a 14X magnification. The thickness of the zinc-nickel alloy deposit was approximately 0.25 to about 0.3 mil. Upon analysis, the alloy contained 13.5% by weight nickel.

EXAMPLE 7

To the electrolyte as described in Example 6, 0.04 g/l of an additive agent was added comprising an ethoxylated sorbitol of an average molecular weight of 475. A rotating steel cathode was electroplated under the same conditions as described in Example 6. The resultant zinc-nickel alloy was of a fine-grained, semi-bright appearance and was adherent as evidenced by being substantially crack-free when bent through an angularity greater than 90 and viewed under 14X magnification. Upon analysis, the alloy contained 7% by weight nickel. Upon atmospheric corrosion testing, this type of electrodeposit exhibits a 15%–20% improvement in corrosion protection as compared to the electrodeposit of Example 6, even though the nickel content is lower.

EXAMPLE 8

To the electrolyte as described in Example 6, 0.015 g/l of an additive agent was added comprising ethoxylated and propoxylated sorbitol of an average molecular weight of 7,200. A rotating steel cathode was electroplated under the same conditions as described in Example 6. The zinc-nickel alloy deposit was of a fine-grained, semi-bright appearance and was adherent as evidenced by a substantially crack-free deposit when bent through an angularity greater than 90. and viewed under 14X magnification. Upon analysis, the zinc-nickel alloy contained 9.6% by weight nickel

EXAMPLE 9

To the electrolyte as described in Example 6, 0.02 g/l of an additive agent was added comprising an ethoxylated methyl glucose (ethoxylated with 10 moles of ethylene oxide). A rotating steel cathode was electroplated under the same conditions as described in Example 6. The resultant zinc-nickel alloy deposit was of a fine-grained appearance and was adherent as evidenced by being substantially crack-free when bent through an angularity of greater than 90° and viewed under 14X magnification. Upon analysis, the alloy contained 6.7% by weight nickel.

EXAMPLE 10

For comparative purposes, an alternative aqueous acidic zinc-nickel electrolyte of the sulfate-type was prepared for functional plating. The electrolyte contained 110 g/l nickel sulfate hexahydrate, 260 g/l zinc sulfate monohydrate and 36 g/l sulfuric acid.

A rotating steel rod cathode was plated in the electrolyte at an average cathode current density of 1,000 ASF with an electrolyte temperature controlled within a range of 50. to 55° C. (120°–130° F.). Insoluble lead anodes were employed. Solution agitation was provided by rotating the steel rod cathode at a speed of 4,600 rpm to provide a surface velocity of 325 feet per minute. The resultant zinc-nickel alloy deposit was of a light gray appearance, grainy and cracked when bent through an angularity of more than 90° as viewed under 14X magnification. The electrodeposit was approximately 0.25 to 0.3 mils thick. Upon analysis, the nickel content was 6.7% by weight of the alloy.

This example shows that a reduction of the nickel content in the electrolyte and in the resultant deposit in comparison to that employed in prior Example 6 to a magnitude as obtained in supplemental Examples 7 through 9, still did not produce a satisfactory zinc-nickel alloy electrodeposit in the absence of the additive agent.

EXAMPLE 11

For comparative purposes, an aqueous acidic sulfate-type zinc-cobalt alloy electrolyte adapted for functional electroplating was prepared containing 60 g/l cobalt sulfate heptahydrate, 450 g/l zinc sulfate monohydrate and 36 g/l sulfuric acid.

A rotating steel rod cathode was electroplated in the electrolyte at an average cathode current density of 1,000 ASF with the electrolyte controlled at a temperature ranging from 40° to 45° C. (104°–112° F.) and employing insoluble lead anodes. Agitation of the electrolyte was provided by rotating the cathode. The rotation of the cathode was at 4,600 rpm providing a surface velocity of 325 feet per minute. Upon inspection, the resultant zinc-cobalt alloy electrodeposit was of a light-gray, coarse-grained, dull appearance. Upon analysis, the cobalt content in the alloy deposit was 0.17% by weight.

EXAMPLE 12

To the electrolyte as described in Example 11, 4 g/l of an additive agent was added comprising ethoxylated, propoxylated sorbitol of an average molecular weight of 6475. A rotating steel cathode was electroplated under the same conditions as described in Example 11 and the resultant zinc-cobalt alloy deposit was of a semi-bright, steel-gray appearance. Upon analysis, the alloy deposit contained 0.26% by weight cobalt.

EXAMPLE 13

To the electrolyte as described in Example 11, an additive agent was added at a concentration of 0.5 g/l comprising propoxylated methyl cellulose (propoxylated with 10 moles propylene oxide). A rotating steel cathode was electroplated under the same conditions as described in Example 11 and the resultant zinc-cobalt alloy deposit was of a semi-bright and gray color appearance. Upon analysis, the cobalt content was 0.29% by weight.

EXAMPLE 14

To the electrolyte as described in Example 11, 0.2 g/l of an ethoxylated methyl glucose additive agent was added (ethyoxylated with 20 moles of ethylene oxide). A rotating steel cathode was electroplated under the same conditions as described in Example 11 and the resultant zinc-cobalt alloy deposit was of a semi-bright gray appearance. Upon analysis, the alloy deposit contained 0.22% by weight cobalt.

EXAMPLE 15

For comparative purposes, an aqueous acidic electrolyte of the sulfate-type suitable for electrodepositing a zinc-iron-nickel-cobalt alloy was prepared containing 100 g/l zinc sulfate monohydrate, 100 g/l ferrous sulfate heptahydrate, 50 g/l nickel sulfate hexahydrate and 50 g/l cobalt sulfate heptahydrate. The pH of the electrolyte was about 4.5.

A rotating steel cathode was electroplated employing the foregoing electrolyte at an average current density of 1,000 ASF with the electrolyte controlled at a temperature between about 50° to about 55° C. (122°–130° F.) employing insoluble lead anodes. The cathode was rotated at a speed to provide a surface velocity of 300 feet per minute. The electrodeposition continued until the deposit averaged about 6 miorometers (0.24 mils) in thickness. Upon inspection, the electrodeposit was of a satiny-gray appearance with dentrites. Upon analysis, the alloy composition contained 74.3% zinc, 14.3% iron, 6.4% cobalt and 5% by weight nickel.

EXAMPLE 16

To the electrolyte as described in Example 15, 0.01 g/l of an additive agent was added comprising ethoxylated sorbitol of an average molecular weight of 1,400. A rotating steel cathode was electroplated employing the same conditions as described in Example 15 and the resulting deposit evidenced an improvement in grain refinement and smoothness of the deposit. Upon analysis, the alloy electrodeposit contained 72.1% zinc, 15.6% iron, 7.6% cobalt and 4.7% by weight nickel

EXAMPLE 17

An aqueous acidic zinc-nickel alloy electrolyte of the chloride-type adapted for electrodepositing decorative zinc-nickel electrodeposits was prepared containing 90 g/l zinc-chloride, 115 g/l nickel chloride hexahydrate, 220 g/l ammonium chloride and 4 g/l of an additive agent comprising ethyoxylated glycerine (ethoxylated with 12 moles ethylene oxide). The elctrolyte further contained as a secondary brightening agent 0.050 g/l benzylidene acetone. The electrolyte was of a pH of about 5.6.

A steel test panel was plated at an average cathode current density ranging from 10 to about 20 ASF with the electrolyte controlled at a temperature of from about 30. to about 35° C. (86°–95° F.). The resultant zinc-nickel alloy deposit was fully bright, decorative and of uniform appearance. Upon analaysis, the alloy deposit contained 11.6% by weight nickel.

EXAMPLE 18

An aqueous acidic zinc-cobalt-nickel electrolyte was prepared suitable for electrodepositing a decorative alloy deposit of the chloride-type containing 90 g/l zinc chloride, 40 g/l cobalt chloride hexahydrate, 120 g/l nickel chloride hexahydrate, 200 g/l ammonium chloride, 3 g/l of an additive agent comprising ethoxylated glycerine (ethoxylated with 12 moles ethylene oxide) and 2 g/l sodium benzoate.

The electrolyte was controlled at a pH of about 5 and a temperature of about 20° to about 25° C. (68°–78° F.) was employed for electroplating a steel test panel at an average cathode current density ranging from 10 to about 20 ASF. The resultant electrodeposit was of a uniform, silvery semi-bright appearance which was commercially acceptable. Upon analysis, the alloy deposit contained 12% by weight nickel, 6% by weight cobalt and the balance zinc.

EXAMPLE 19

To the electrolyte as described in Example 18, a supplemental brightener mixture was added comprising 0.06 g/l of 4-phenyl-3-buten-2-one, 0.02 g/l of butyl nicotinate dimethyl sulfate quaternary and 0.05 g/l of 4-phenyl-4-sulfobutan-2-one, sodium salt.

A steel test panel was electroplated employing zinc anodes in accordance with the procedure as set forth in Example 18. The resultant alloy deposit was very decorative and fully bright in appearance. Upon analysis, the alloy deposit contained 11.9% by weight nickel, 6.5% by weight cobalt with the balance comprising zinc.

EXAMPLE 20

For comparative purposes, an aqueous acidic zinc-cobalt electrolyte was prepared of the chloride-type suitable for electrodepositing a decorative zinc-cobalt deposit containing 46 g/l zinc chloride, 10.5 g/l cobalt chloride hexahydrate, I75 g/l sodium chloride, 20 g/l boric acid and 2 g/l sodium benzoate. The pH of the electrolyte was about 5.2. Standard Hull cell panels were plated with the electrolyte at about 75° F. at a current of 1 ampere for a period of 10 minutes in the absence of agitation. The resultant test panel was of a dull-black to gray-black grainy appearance. The average alloy content of the adherent electrodeposit in the current density range of 0–40 ASF was 5.03% by weight cobalt and the balance zinc.

EXAMPLE 21

To the electrolyte as described in Example 20, 3 g/l of an additive agent was added comprising ethoxylated glycerine (ethoxylated with 12 moles of ethylene oxide). A Hull test panel was again plated under the same conditions as described in Example 20 and the resultant electrodeposit was of a uniform, silver-white, semi-bright appearance in the current density range of from 2 to 60 ASF. The average alloy content was 1.03% by weight cobalt and the balance zinc. This amount of alloy content in the electrodeposit has been shown to increase corrosion resistance by 2 to 3 times over an ordinary zinc electrodeposit and is commercially acceptable. Such a relatively low cobalt level is commercially desirable because it facilitates employment of known chromate conversion coatings, thereby improving the alloy's resistance to white corrosion products.

EXAMPLE 22

To the electrolyte as described in Example 20, 4 g/l of an additive agent was added comprising ethoxylated glycerine (ethoxylated with 26 moles of ethylene oxide). A Hull test panel was again plated under the same conditions as described in Example 20 and the resultant electrodeposit was of a uniform, silver-white, semi-bright appearance in the current density range between 2 to 60 ASF. The average alloy content was 1.59% by weight cobalt and the balance zinc. Such a relatively low cobalt level is commercially desirable because that level facilitates employment of known chromate conversion coatings, thereby improving the alloy's resistance to white corrosion products.

EXAMPLE 23

For comparative purposes, an aqueous acidic electrolyte of the chloride-type was prepared suitable for electrodepositing a zinc-cobalt alloy containing 46 g/l zinc chloride, 10.5 g/l cobalt chloride hexahydrate, 220 g/l potassium chloride, 20 g/l boric acid, and 3.5 g/l sodium benzoate. The pH of the electrolyte was controlled at about 5 and a temperature at 25° C. (77° F.).

A test panel was plated in a standard Hull cell at a current of 1 ampere for a period of 10 minutes employing a zinc anode in the absence of agitation. The resultant electrodeposit was dull-black to gray-black and of a grainy appearance. The average alloy composition was 1.2% by weight cobalt in the 0–20 ASF current density range and about 5.7% by weight cobalt in the test panel area above 20 ASF current density.

EXAMPLE 24

To the electrolyte as described in Example 23, 4 g/l of an additive agent was added comprising ethoxylated (15 moles) trimethylol propane. A Hull cell test panel was again plated under the same conditions as described in Example 23 and the electrodeposit was uniform and of a silver-white, semi-bright appearance across the entire surface of the test panel. The average alloy composition was 1.15% by weight cobalt in the 0–20 ASF current density range and 6.82% by weight cobalt in the cathode current density range above 20 ASF.

EXAMPLE 25

To the electrolyte as described in Example 24, 0.06 g/l was added of 4-phenyl-4-sulfobutan-2-one, sodium salt; 0.075 g/l benzylidene acetone and 0.003 g/l butyl nicotinate diethyl sulfate quaternary. A Hull test panel was again plated under the same conditions as described in Example 23 and the electrodeposit was fully bright, uniform and of a decorative quality across the entire surface of the test panel. The cobalt alloy distribution was 1% by weight cobalt in the 0–20 ASF current density range and 2.1% by weight cobalt in the cathode current density range above 20 ASF.

EXAMPLE 26

To the electrolyte in Example 23, 0.05 g/l of ethoxylated glycerine, having an average molecular weight of about 1,157, was added together with 70 mg/l of 2-chlorobenzaldehyde, predisolved in a diethylene glycol solvent. In a 3,000 l tank, steel parts were plated using compressed air agitation of the solution at a current density of about 1.5 A/dm$^2$. The resulting parts had a bright uniform deposit with approximately a 0.6% cobalt alloy content. The resulting corrosion protection for such parts was about 2 to about 3 times that of a similarly deposited pure zinc as measured by ASTM D-117 5% neutral salt spray test.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic electrolyte suitable for electrodepositing zinc alloys on a conductive substrate comprising an effective amount of an additive agent comprising a bath soluble polyhydroxy compound having three or more hydroxyl groups at least one of which is substituted with an oxyalkylene group present in an amount effective to provide grain refinement of the zinc alloy electrodeposit, wherein said additive agent is substantially free of fatty acids or fatty acid moieties; zinc ions present in an amount of about 10 g/l to saturation; and an additional metal ion selected from the group consisting of iron ions present in an amount of about 5 to about 140 g/l, nickel ions present in an amount of about 0.5 to about 120 g/l, cobalt ions present in an amount of about 0.5 to about 120 g/l, and mixtures thereof.

2. The electrolyte as defined in claim 1 in which said additional metal ion comprises iron ions present in an amount of about 5 to about 14 g/l.

3. The electrolyte as defined in claim 2 in which said additional metal ion further comprises cobalt ions present in an amount of about 0.5 to about 120 g/l.

4. The electrolyte as defined in claim 2 in which said additional metal ion further comprises nickel ions present in an amount of about 0.5 to about 120 g/l.

5. The electrolyte as defined in claim 1 in which said additional metal ion comprises iron ions present in an amount of about 5 to about 140 g/l and said electrolyte further including a complexing agent present in an amount sufficient to maintain an effective amount of iron ions in solution.

6. The electrolyte as defined in claim 1 in which said additional metal ion comprises iron ions present in an amount of about 5 to about 140 g/l and said electrolyte further including a reducing agent present in an amount effective to reduce at least a portion of any ferric ions to the ferrous state.

7. The electrolyte as defined in claim 1 in which said additional metal ion comprises nickel present in an amount of about 0.5 to about 120 g/l.

8. The electrolyte as defined in claim 7 in which said additional metal ion further comprises cobalt present in an amount of about 0.5 to about 120 g/l.

9. The electrolyte as defined in claim 1 in which said additional metal ion comprises cobalt present in an amount of about 0.5 to about 120 g/l.

10. The electrolyte as defined in claim 1 in which said electrolyte comprises iron ions and at least one of nickel ions and cobalt ions in combination with zinc ions to provide an alloy deposit containing about 1 percent to about 25 percent iron in combination with about 0.1 percent to about 20 percent by weight nickel and/or about 0.1 percent to about 12 percent cobalt and the balance essentially zinc.

11. The eleotrolyte as defined in claim 1 further containing conductivity salts present in an amount sufficient to increase the electrical conductivity of the electrolyte.

12. The electrolyte as defined in claim 1 further including hydrogen ions present in an amount to provide a pH of about 0 to about 7.

13. The electrolyte as defined in claim 1 further including hydrogen ions present in an amount to provide a pH of about 2 to about 6.

14. The electrolyte as defined in claim 1 in which said additive agent is present in an amount of about 0.005 to about 20 g/l.

15. The electrolyte as defined in claim 1 in which said additive agent is present in an amount of about 0.02 to about 10 g/l.

16. The electrolyte as defined in claim further including a supplemental brightening agent present in an amount up to about 10g/l.

17. A process for electrodepositing a zinc alloy on a substrate comprising the steps of contacting a cathodically electrified substrate with an aqueous acidic electrolyte according to claim 1 to impart grain refinement to the zinc alloy electrodeposit and continuing the electrodeposition of the zinc alloy until the desired thickness is obtained.

18. The process as defined in claim 17 including the further step of controlling the temperature of the electrolyte within a range of about 60° to about 180° F.

19. The process as defined in claim 17 including the further step of controlling the temperature of the electrolyte within a range of about 70° to about 140° F.

20. The process as defined in claim 17 in which the step of electrodepositing the zinc alloy is performed at an average cathode current density of about 1 to about 2000 ASF.

21. An aqueous acidic electrolyte suitable for electrodepositing zinc alloys on a conductive substrate comprising zinc ions and at least one additional metal ion selected from the group consisting of nickel, cobalt, iron and mixtures thereof present in an amount sufficient to electrodeposit a zinc alloy, and an effective amount of an additive agent comprising a bath soluble polyhydroxy compound having at least 3 carbon atoms and three or more hydroxyl groups, and wherein at least one of said hydroxyl groups is substituted with a polyoxyalkylene polymer group, and wherein said additive agent is present in an amount effective to provide grain refinement of the zinc alloy electrodeposit, and further wherein said additive agent is substantially free of fatty acids or fatty acid moieties.

22. The electrolyte as defined in claim 21 in which said zinc ions are present in an amount of about 10 g/l up to saturation.

23. The electrolyte as defined in claim 21 in which said additional metal ion comprises nickel, cobalt, and mixtures thereof present in an amount of about 0.5 to about 120 g/l.

24. The electrolyte as defined in claim 21 in which said additional metal ion comprises iron ions present in an amount of about 5 to about 140 g/l.

25. The electrolyte as defined in claim 21 in which said additional metal ion comprises iron ions and said electrolyte further including a complexing agent present in an amount sufficient to maintain an effective amount of iron ions in solution.

26. The electrolyte as defined in claim 21 in which said additional metal ion comprises iron ions and said electrolyte further including a reducing agent present in an amount effective to reduce at least a portion of any ferric ions to the ferrous state.

27. The electrolyte as defined in claim 21 in which said additional metal ion comprises iron ions and at least one of nickel ions and cobalt ions in combination with zinc ions to provide an alloy deposit containing about 1 percent to about 25 percent iron in combination with about 0.1 percent to about 20 percent by weight nickel and/or about 0.1 percent to about 12 percent cobalt and the balance essentially zinc.

28. The electrolyte as defined in claim 21 further containing conductivity salts present in an amount sufficient to increase the electrical conductivity of the electrolyte.

29. The electrolyte as defined in claim 21 further including hydrogen ions present in an amount to provide a pH of about 0 to about 7.

30. The electrolyte as defined in claim 21 further including hydrogen ions present in an amount to provide a pH of about 2 to about 6.

31. The electrolyte as defined in claim 21 in which said additive agent is present in an amount of about 0.005 to about 20 g/l.

32. The electrolyte as defined in claim 21 in which said additive agent is present in an amount of about 0.02 to about 10 g/l.

33. The electrolyte as defined in claim 21 further including a supplemental brightening agent present in an amount up to about 10 g/l.

34. The electrolyte as defined in claim 21 wherein the non-fatty acid polyoxyalkylene group is selected from the group consisting of oxyethylene, oxypropylene, glycidol, oxybutylene, or mixtures thereof.

35. The electrolyte as defined in claim 21 wherein the oxyalkylene group is present in the range of from about 2 to about 120 moles per mole of additive agent.

36. The electrolyte as defined in claim 21 wherein the oxyalkylene group is present in the range of from about 12 to about 40 moles per mole of additive agent.

37. The electrolyte as defined in claim 21 wherein the polyhydroxy compound is selected from the group consisting of sorbitol, glucose, methyl glucose, gluconic acid, glucaric acid, mannitol, fructose, glycerin, trimethylol propane, pentaerythritol, trihydroxy butane, trihydroxy butanone, trihydroxy hexane, chlorobutane triol, 2-ethyl, -2-(hydroxymethyl) 1,3 propane diol, tris(-hydroxymethyl)ethane, tris(hydroxymethyl)amino methane, 3-[tris(hydroxymethyl)methyl amino]1-propane sulfonic acid, tricine, or mixtures thereof.

38. The electrolyte as defined in claim 21 wherein the polyhydroxy compound is selected from the group consisting of sorbitol, methylglucose, glycerin, trimethylol propane, pentaerythritol, trihydroxy butane, tris(-hydroxymethyl)ethane, or mixtures thereof.

39. The electrolyte as defined in claim 21 wherein the polyhydroxy compound is selected from the group consisting of sorbitol, methylglucose, glycerin, trimethylol propane, or mixtures thereof.

40. The electrolyte as defined in claim 21 wherein the additive agent has a final molecular weight of from about 100 to about 10,000.

41. The electrolyte as defined in claim 21 wherein the additive agent has a final molecular weight of from about 500 to about 8,000.

42. A process for electrodepositing a zinc alloy or a substrate comprising the steps of contacting a cathodically electrified substrate with an aqueous acidic electrolyte comprising zinc ions and at least one additional metal ion selected from the group consisting of nickel, cobalt, iron and mixtures thereof present in an amount sufficient to electrodeposit a zinc alloy, and an effective amount of an additive agent comprising a bath-soluble polyhydroxy compound having at least 3 carbon atoms and three or more hydroxyl groups and wherein at least one of said hydroxyl groups is substituted with a polyoxyalkylene polymer group to impart grain refinement to the zinc alloy electrodeposit, and further wherein said additive is substantially free of fatty acids or fatty acid moieties, and continuing the electrodeposition of the zinc alloy until the desired thickness is obtained.

43. The process as defined in claim 42 including the further step of controlling the temperature of the electrolyte within a range of about 60° F. to about 180° F.

44. The process as defined in claim 43 including the further step of controlling the concentration of the zinc ions, iron ions, and either one of the cobalt ions and/or nickel ions to electrodeposit a zinc alloy containing from about 1 to about 25% by weight iron, about 0.1 to about 20% nickel and/or about 0.1 to about+12% cobalt.

45. The process as defined in claim 42 including the further step of controlling the temperature of the electrolyte within a range of about 70° F. to about 140° F.

46. The process as defined in claim 45 including the further step of controlling the concentration of additive agent within a range of about 0.005 to about 20 g/l.

47. The process as defined in claim 42 in which the step of electrodepositing the zinc alloy is performed at an average cathode current density of about 1 to about 2000 ASF.

48. The process as defined in claim 42 including the further step of controlling the concentration of the zinc ions and either one of the nickel and/or cobalt ions to provide a zinc alloy containing about 0.1 to about 30% by weight nickel and/or cobalt.

49. The process as defined in claim 42 including the further step of controlling the concentration of additive agent within a range of about 0.02 to about 10 g/l.

50. The process as defined in claim 42 wherein the non-fatty acid polyoxyalkylene group is selected from the group consisting of oxyethylene, oxypropylene, glycidol, oxybutylene, or mixtures thereof.

51. The process as defined in claim 42 wherein the oxyalkylene group is present in the range of from about 2 to about 120 moles per mole of additive agent.

52. The process as defined in claim 42 wherein the oxyalkylene group is present in the range of from about 12 to about 40 moles per mole of additive agent.

53. The process as defined in claim 42 wherein the polyhydroxy compound is selected from the group consisting of sorbitol, glucose, methyl glucose, gluconic acid, glucaric acid, mannitol, fructose, glycerin, trimethylol propane, pentaerythritol, trihydroxy butane, trihydroxy butanone, trihydroxy hexane, chlorobutane triol, 2-ethyl, -2-(.hydroxymethyl) 1,3 propane diol, tris(hydroxymethyl)ethane, tris(hydroxymethyl)amino methane, 3-[tris(hydroxymethyl)methyl amino]1-propane sulfonic acid, tricine, or mixtures thereof.

54. The process as defined in claim 53 wherein the polyhydroxy compound is selected from the group consisting of sorbitol, methylglucose, glycerin, trimethylol propane, pentaerythritol, trihydroxy butane, tris(-hydroxymethyl)ethane, or mixtures thereof.

55. The process as defined in claim 53 wherein the polyhydroxy compound is selected from the group consisting of sorbitol, methylglucose, glycerin, trimethylol propane, and mixtures thereof.

* * * * *